United States Patent [19]

Hugh et al.

[11] 4,245,528

[45] Jan. 20, 1981

[54] PUSH BUTTON SOCKET RELEASE MECHANISM

[75] Inventors: Melvin D. Hugh, Wilmington, Calif.; Walter C. Vliet, Landing, N.J.

[73] Assignee: Ingersoll-Rand Company, Woodcliff Lake, N.J.

[21] Appl. No.: 43,102

[22] Filed: May 29, 1979

[51] Int. Cl.[3] ..... B25B 13/00

[52] U.S. Cl. ..... 81/177 G

[58] Field of Search ..... 81/62, 63.2, 177 G, 81/180 R

[56] References Cited

U.S. PATENT DOCUMENTS

| | | | |
|---|---|---|---|
| 3,208,318 | 9/1965 | Roberts | 81/177 G |
| 3,393,587 | 7/1968 | Jolliff et al. | 81/63.2 |
| 3,532,013 | 10/1970 | Haznar | 81/62 |
| 3,713,356 | 1/1973 | Knudsen | 81/177 G |
| 3,762,245 | 10/1973 | Smyers et al. | 81/177 G |

*Primary Examiner*—James G. Smith

*Attorney, Agent, or Firm*—Walter C. Vliet

[57] ABSTRACT

An improved push button socket release mechanism which utilizes a locking ramp form which provides for a wide range of socket retention fit, and improves both the self-locking and anti-rattle capability of the socket retention mechanism.

5 Claims, 6 Drawing Figures

PUSH BUTTON SOCKET RELEASE MECHANISM

BACKGROUND OF THE INVENTION

In recent years, a number of reversing ratchet wrench mechanisms have been developed which further include a device allowing ready release of a socket. These are known as the so-called push button release ratchet wrenches. Typical designs of these are shown in patents issued to Roberts, U.S. Pat. No. 3,208,318, Joliff, U.S. Pat. No. 3,393,587, and Hasnar, U.S. Pat. No. 3,532,013.

The present invention is an improvement of the push button release ratchet wrench. Most push button socket release reversing wrenches on the consumer market utilizes a deep ramp spring loaded stem which forces against a ball or pellet which in turn is forced outward of the socket drive member and against the socket to be retained. The ramp angle is generally 45 degrees or larger, thus permitting a short push button stem stroke or travel to lock or release the socket.

Because of these configurations, socket retention is relatively weak and almost negligible where the socket detent is marginal or nonexistant. The high ramp angle further requires a very strong spring force to cam the ball or pellet against the socket, and thus socket retention is very dependent on the stem spring action.

One attempt to cure this problem has been the use of a steep ramp to cam the ball or pellet outward and a straight sided land to hold the ball out against the socket. Although extremely effective on close tolerance sockets with adequate detents, this design has limited range and socket tolerance capability. Thus, large sockets tend to rattle, and in an extreme case would not be retained or partially jam against the retaining ball or pellet element. A slightly longer push button stem stroke is also required, in that, at least during the stroke travel where the ball rested on the land, it was not cammed further outward.

SUMMARY OF THE INVENTION

The object of the present invention is to provide a simple, reliable, economical and easy to use push button release ratchet wrench.

A particular object of the present invention is to provide an improved push button stem having an improved ramp configuration.

A further object of the invention is to provide a first portion of the ramp section which rapidly cams the lock ball or pellet outwards against the socket and a second portion of ramp section which further cams the locking ball or pellet against the socket while retaining the self-locking characteristics of an axially oriented land.

A further object of the invention is to provide a wrench which is self-locking, anti-rattle, smooth acting and has a relatively short socket release operating stroke.

These and other objects are obtained in a push button socket release mechanism for a ratchet wrench having an output drive comprising: displaceable means in the output drive for retaining a socket on the output drive, the displaceable means being moveable from a position in register with a socket disposed on the output drive, whereby the socket is retained on the output drive, to a position out of register with the socket, whereby the socket is released from the output drive; a cam means in the output drive for displacing the displaceable means; the cam means having a first cam portion of relatively steep slope for effecting substantial movement of the displaceable means in response to an increment of movement of the cam means, and a second cam portion of relatively shallow slope for effecting appreciable but relatively less movement of the displaceable means in response to a like increment of movement of the cam means.

DESCRIPTION OF PREFERRED EMBODIMENT

Figure 1:
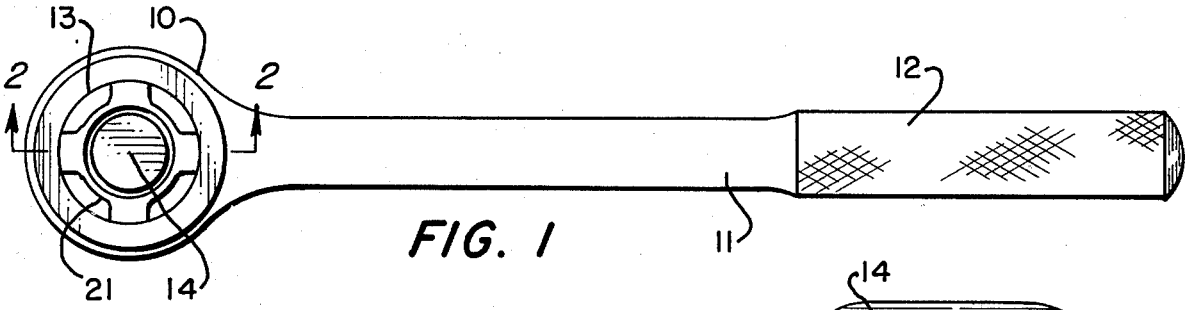
FIG. 1 is a plan view of a ratchet wrench incorporating the present invention.

Referring to FIG. 1, a conventional round head ratchet wrench is shown having a head porton 10, a shank portion 11, and knurled handle portion 12.

Wrenches of this type are commonly provided with a knob 13 for accomplishing the reversing of the ratchet wrench. The present invention is also provided with a push button 14 for releasably securing a conventional socket 90 to the commonly provided square drive output 15, best seen in FIG. 2.

Figure 2:
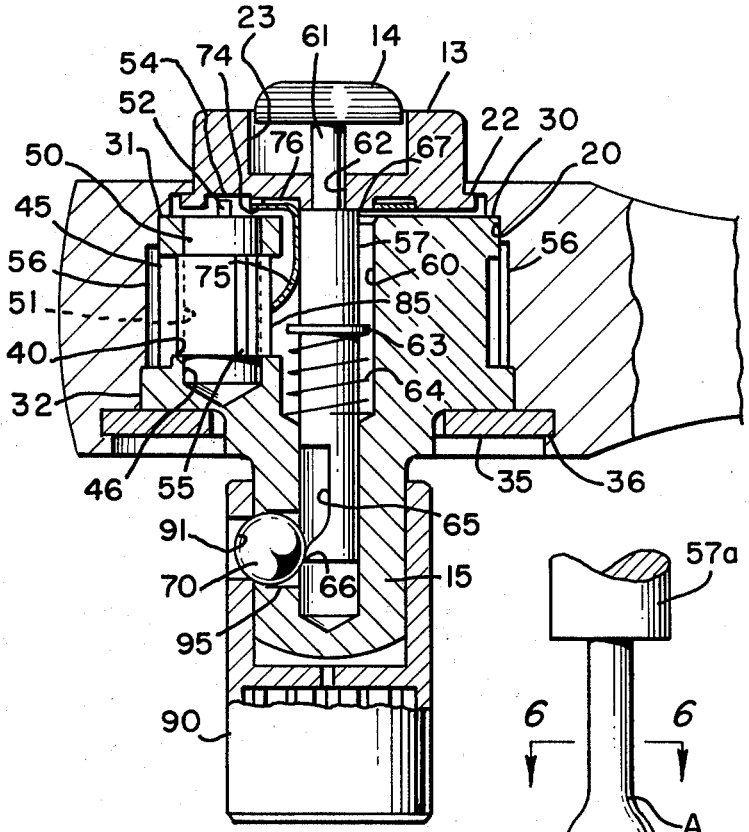
FIG. 2 is a cross sectional elevation view of a portion of the head of the ratchet taken at Section 2—2 of FIG. 1.

FIG. 2 is an elevation cross section view taken through the head portion of the ratchet wrench at Section 2—2 on FIG. 1. FIG. 2 shows the principle components of the reversing ratchet mechanism.

The head is provided with a through bore 20, which is progressively stepped to a larger diameter from top to bottom to accommodate the ratchet release components.

A disc shaped knob 13 is shown inserted in the top portion of the head. The upper portion of the reversing knob is provided with 4 spaced recesses 21 which provide a convenient grip for rotating the reversing knob about its vertical axis. The reversing knob is also provided with a slip flange 22 which serves to retain the reversing knob in the through bore 20. In addition, the reversing knob is provided with a counter bore 23 which provides a suitable recess into which the push button 14 may be depressed.

Also inserted in the through bore just below the reversing knob is a core member 30 which is rotatably disposed in the through bore for rotation about its vertical axis. The core member 30 is provided with an upper flange 31 and a lower flange 32. Flange 31 and 32 provide the required bearing surface for rotation and further prevent the core member from moving vertically upward in the through bore. A retaining ring 35 is disposed in a ring groove 36 and serves to retain the core member in the through bore by preventing its vertically downward movement.

The core member is provided with a segment cut 40 which extends for nearly one half of the diameter of the core member and which is wide enough to slidingly receive a reversing ratchet cog 45. A portion of the core member above and below the segment cut serves to align the reversing ratchet cog.

A bore 46 extending vertically through the segment cut portion of the core member receives a pivot pin 50. The pivot pin 50 is further disposed through a center bore 51 of the reversing ratchet cog as shown on FIG. 2 and serves to secure the reversing ratchet cog and allow it to rock about its vertical axis in the segment cut.

The pivot pin is further provided with a stop projection 52, which is conveniently cylindrical. The stop 52 projects into a recess 54 in the reversing knob and serves to limit the rotation of the reversing knob. The reversing ratchet cog is provided with gripping teeth 55 at both of its extreme ends.

The center to tip gripping teeth diameter is such that when the reversing ratchet cog is centrally aligned in the segment cut the teeth do not interact with the through bore 20. However, as can be appreciated by one skilled in the art, if the reverse ratchet cog is sufficiently rotated about the pivot pin, it will cause engagement of the gripping teeth 55 with corresponding bore teeth 56 which are provided in through bore 20 as shown in FIG. 2. Depending on the direction of the offset, the core member may be rotated either clockwise or counterclockwise relative to the ratchet wrench head. This is a conventional means of accomplishing the reversing ratchet function of a typical round headed ratchet wrench and can best be seen in FIG. 2. The reversing knob 13 accomplishes reversing of the ratchet wrench by displacing the reversing ratchet cog 45. A finger spring 75 is provided to accomplish the action. The spring is provided with a horizontal base portion 74 which is secured to the reversing knob in a recess 76.

In place the finger creates a force on the control surface 85 which pulses to the left as shown on FIG. 2. This force depending on its point of contact on surface 85 creates the rocking action of the reversing ratchet cog required to reverse the ratchet mechanism. In addition, it serves to give a positive detent feel to the reversing knob.

The combination of the coil force spring 64 and the finger spring 75 force must be carefully chosen to provide the proper reversing force and reversing knob feel in combination with an appropriate push button force.

The core member 30 is further provided with a stepped center bore 60 which receives a release shaft 57. The release shaft 57 is connected to the push button 14 by means of a slightly reduced diameter area 61 which passes through a bore 62 in the reversing knob 13. The collar 67 formed at the reduced diameter serves to limit the vertically upward movement of the release shaft. In addition, the release shaft is provided with a boss collar 63 which cooperates with a coil force spring 64 to impart a vertically upward force to the release shaft. The core member 30 is also provided with a transverse bore 95, which slidably contains a socket locking member or lock ball 70.

The release shaft at its lower end is provided with a segment cut 65 which provides a recess for a lock ball 70 to retract into when the push button 14 is depressed.

Figure 3:
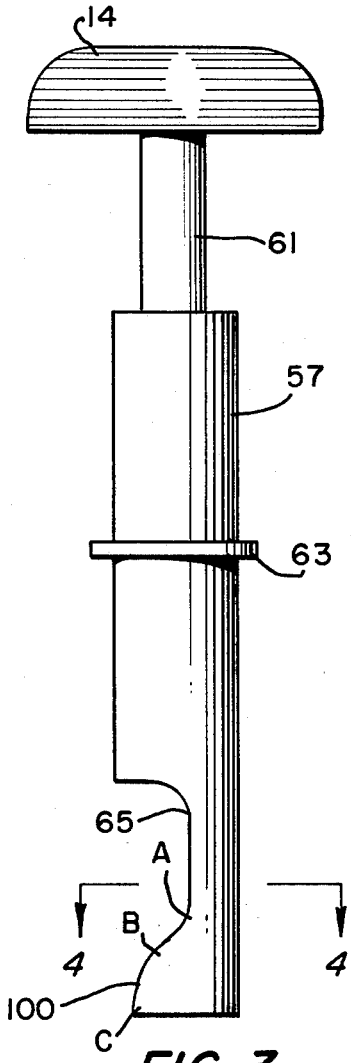
FIG. 3 is a detailed elevation view of the improved push button stem of this invention.
Figure 6:
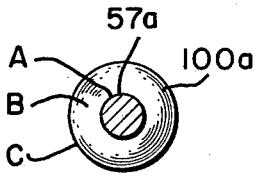
FIG. 6 is a plan cross sectional view taken at Section 6—6 of FIG. 5.

The release shaft 57 is provided with a cam section 100, which can be seen on FIG. 3. The cam is utilized to force the lock ball 70 outwards of the square drive and into contact with the socket 90. The lock ball 70 contacts the socket generally in a recess 91 which may be in the form of a dimple, through hole, or any other convenient recess form normally provided in a well made conventional socket. Where no such recess is provided, the ball will contact the socket wall.

The cam section 100 is comprised of a first relatively steep ramp section indicated as section AB on FIG. 3. The cam section varies from a relatively straight deep slope near point A to a gradually decreasing slope near point B. This portion will rapidly cam the lock ball outward and is primarily dependent upon the coil force spring 64 for any locking force. The cam section designated as BC continues the gradual reduction in slope, and may be characterized as the self-locking portion of the cam. Here, the lock force is not primarily dependent upon the coil spring, but rather upon the cam angle itself to maintain the lock ball in its outward lock position. The coil spring, of course, plays a part in returning the stem directionally to its normal position.

Figure 5:
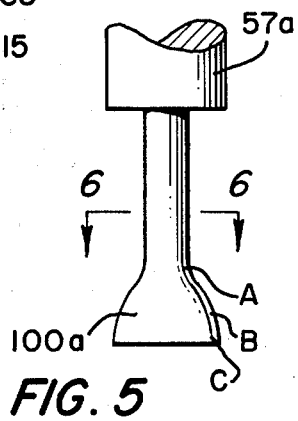
FIG. 5 is a detailed elevational view of the push button stem showing an alternate embodiment of the invention.
Figure 4:
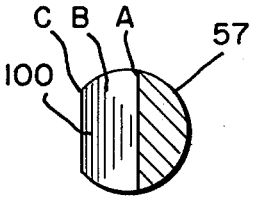
FIG. 4 is a plan cross sectional view taken at Section 4—4 of FIG. 3.

FIG. 4 shows a cross sectional view of the cam taken at Section 4—4 showing the cross sectional view of the cam. FIG. 5 shows an alternative embodiment of the invention wherein the cam surface **100*a* is formed circularly about the stem 57*a***. This alternative may offer some economy of manufacture, in that, the cam surface is generated by turning as opposed to a broaching operation, and may be desirable where the stem is allowed to rotate.

As can be appreciated by one skilled in the art, to place a socket on the square drive 15 of the core member, it is necessary to depress the push button to allow the lock ball to retract into the segment cut recess 65. Once the socket has been inserted on the square drive, the push button is released and the lock ball is pushed out into its extended locking position by cam section 100. The cam section also securely holds the ball in place and, therefore, the socket in place in normal operation. To release the socket, it is necessary to again depress the push button 14.

While we have described an embodiment of the invention, it should be obvious to one skilled in the art that several modifications are possible within the scope of the invention.

Applicants do not wish to be limited in the scope of the invention except as claimed.

We claim:

1. A push button socket release mechanism for a ratchet wrench having an output drive comprising:

a displaceable means in the output drive for retaining a socket on the output drive;

said displaceable means being moveable along a path from a position in register with a socket disposed on said output drive whereby said socket is retained on said output drive to a position out of register with said socket whereby said socket is released from said output drive;

a cam means in said output drive moveable along an axis substantially perpendicular to the path of said displaceable means for displacing said displaceable means; and said cam means having a first contacted cam portion of relatively steep slope for effecting substantial outward movement of said displaceable means in response to an increment of movement of said cam means and a second contacted cam portion of relatively shallow slope for effecting appreciable but relatively less outward movement of said displaceable means in response to a like increment of movement of said cam means.

2. The push button socket release mechanism of claim 1 wherein:

said displaceable means is displaced transversely outward from said output drive in response to axial displacement of said cam means within said output drive.

3. The push button socket release mechanism of claim 2 wherein:

said displaceable means is a lock ball.

4. The push button socket release mechanism of claim 3 wherein:

said cam means is formed on a stem which is axially displaceable within said drive means by a push button.

5. The push button socket release mechanism of claim 1 wherein:

said cam means includes a cam surface having a first portion of the surface providing a steep non-locking cam and a second portion of the surface providing a positive but less steep self locking cam.

* * * * *